US008780428B2

(12) United States Patent
Kusuda et al.

(10) Patent No.: US 8,780,428 B2
(45) Date of Patent: Jul. 15, 2014

(54) LIGHT SCANNING DEVICE

(75) Inventors: Shinya Kusuda, Nagoya (JP); Shogo Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 498 days.

(21) Appl. No.: 13/069,794

(22) Filed: Mar. 23, 2011

(65) Prior Publication Data

US 2011/0235144 A1 Sep. 29, 2011

(30) Foreign Application Priority Data

Mar. 24, 2010 (JP) ..... 2010-067426

(51) Int. Cl.
*G02B 26/12* (2006.01)

(52) U.S. Cl.
USPC ..... 359/198.1; 359/216.1

(58) Field of Classification Search
USPC ..... 359/198.1, 212.1, 216.1, 218.1, 219.1, 359/217.1; 347/245, 263
See application file for complete search history.

(56) References Cited

U.S. PATENT DOCUMENTS 5,196,956 A * 3/1993 Sugiura ..... 359/198.1
5,357,272 A * 10/1994 Watanabe et al. ..... 347/257
6,137,614 A * 10/2000 Endoh ..... 359/196.1
6,813,052 B2 * 11/2004 Yoshizawa ..... 359/216.1
2003/0090563 A1 * 5/2003 Tomita et al. ..... 347/245

FOREIGN PATENT DOCUMENTS

| | | | |
|---|---|---|---|
| JP | 10-115794 | A | 5/1998 |
| JP | 11-038347 | A | 2/1999 |
| JP | 11-194293 | A | 7/1999 |
| JP | 11174361 | A | 7/1999 |
| JP | 11249056 | A | 9/1999 |
| JP | 2003-015071 | A | 1/2003 |
| JP | 2003236126 | A | 8/2003 |
| JP | 2004284662 | A | 10/2004 |
| JP | 2006-126506 | A | 5/2006 |

OTHER PUBLICATIONS

Office Action received in corresponding Japanese Patent Application No. 2010-067426 mailed on Nov. 20, 2012.
Notification of Reason for Refusal for Japanese patent application No. 2010-067426 mailed Jan. 24, 2012.

* cited by examiner

*Primary Examiner* — Frank Font
(74) *Attorney, Agent, or Firm* — Banner & Witcoff, Ltd.

(57) ABSTRACT

A light scanning device includes: a light source configured to emit a light beam; a deflector configured to deflect and scan the light beam from the light source in a main scanning direction; a driving source that drives the deflector; and a housing including a support wall to which the driving source is fixed. The support wall has a first surface, a second surface to which the driving source is fixed and that is deviated with respect to the first surface in a direction perpendicular to the first surface, and a third surface that connects the first surface and the second surface and is inclined to form obtuse angles relative to the first surface and the second surface.

9 Claims, 8 Drawing Sheets

LIGHT SCANNING DEVICE

BACKGROUND

The disclosure relates to a light scanning device.

In image forming apparatuses such as laser printers, a light scanning device is generally mounted which exposes a surface of a photosensitive member. A light scanning device is known which has, in a housing (optical box), a light source unit, a deflector (polygonal rotating mirror) deflecting and scanning laser light and a motor (scanner motor) rotating the deflector.

The housing of the light scanning device has a surface of a bottom to which the motor is fixed and which is vertically dented, with respect to a peripheral surface thereof, so as to increase strength.

SUMMARY

The housing of the light scanning device is generally formed by injecting resin into a mold, such as injection molding. Therefore, when the surface to which the motor is fixed is vertically dented, with respect to the peripheral surface, as the housing of the conventional light scanning device, fluidity of the resin is decreased in the mold.

One aspect of the disclosure is to provides a light scanning device capable of improving strength of a housing and fluidity of resin during the molding.

According to the aspect of the disclosure, a light scanning device includes:

a light source configured to emit a light beam;

a deflector configured to deflect and scan the light beam from the light source in a main scanning direction;

a driving source that drives the deflector; and a housing including a support wall to which the driving source is fixed, wherein the support wall has a first surface, a second surface to which the driving source is fixed and that is deviated with respect to the first surface in a direction perpendicular to the first surface, and a third surface that connects the first surface and the second surface and is inclined to form obtuse angles relative to the first surface and the second surface.

DESCRIPTION OF PREFERRED EXEMPLARY EMBODIMENTS

In the followings, exemplary embodiments will be specifically described with reference to the accompanying drawings. In the below descriptions, a schematic configuration of an image forming apparatus having a light scanning device according to an exemplary embodiment will be first described and then detailed configurations of the light scanning device will be described.

<Schematic Configuration of Laser Printer>

Figure 1:
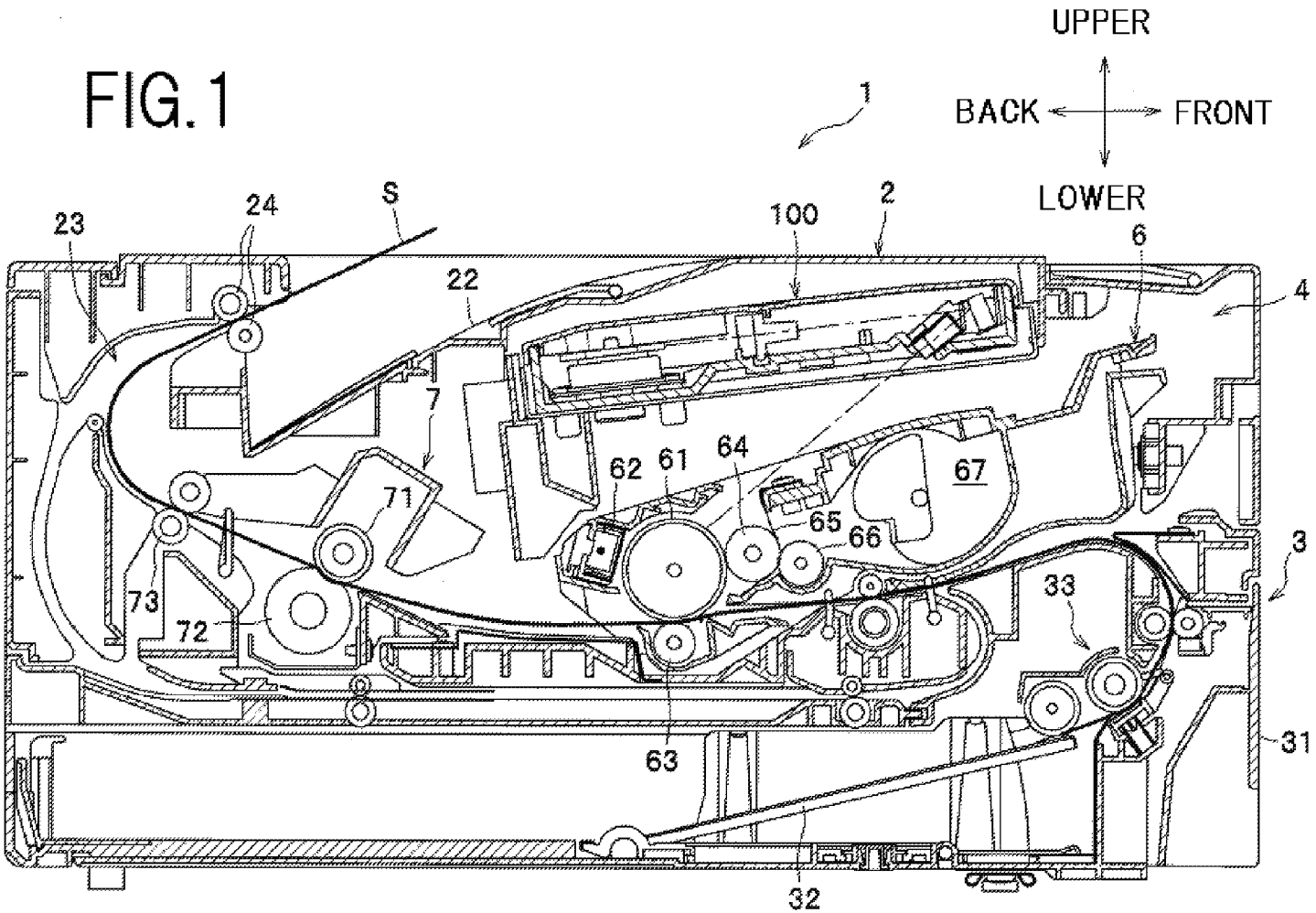
FIG. 1 shows a schematic configuration of a laser printer having a light scanning device according to an exemplary embodiment of the invention.

As shown in FIG. 1, a laser printer 1 (image forming apparatus) includes a feeder unit 3 that feeds sheets S in a body casing 2 and an image forming unit 4 that forms an image on the sheet S.

Meanwhile, regarding the descriptions of the laser printer 1, the directions are set on the basis of a user who uses the laser printer 1. Specifically, in FIG. 1, the right side, the left side, the front side and the inner side are referred to as "front," "back," "left" and "right," respectively. In addition, the upper and lower directions in FIG. 1 are referred to as "upper-lower" direction.

The feeder unit 3 is provided at a lower part in the body casing 2 and includes a sheet feeding tray 31, a sheet pressing plate 32 and a sheet feeding mechanism 33. The sheets S in the sheet feeding tray 31 are upwardly inclined by the sheet pressing plate 32 and supplied to the imaging forming unit 4 by the sheet feeding mechanism 4.

The image forming unit 4 includes a light scanning device 100, a developing unit 6 and a fixing unit 7.

The light scanning device 100 is arranged at an upper part in the body casing 2 and emits laser light (dashed line) based on image data to expose a surface of a photosensitive drum 61, thereby forming an electrostatic latent image. The detailed configuration of the light scanning device 100 will be described below.

The developing unit 6 is arranged below the light scanning device 100 and is detachably mounted to the body casing 2 through an opening formed when opening a front cover mounted to the body casing 2. The developing unit 6 includes a photosensitive drum 61, a charger 62, a transfer roller 63, a developing roller 64, a layer thickness regulating blade 65, a supply roller 66 and a toner accommodating unit 67 that accommodates toner (developer) therein.

In the developing unit 6, a surface of the photosensitive drum 61 is uniformly charged by the charger 62 and then exposed by the laser light from the light scanning device 100, so that an electrostatic latent image based on image data is formed on the photosensitive drum 61. Toner in the toner accommodating unit 67 is supplied to the developing roller 64 through the supply roller 66, is introduced between the developing roller 64 and the layer thickness regulating blade 65 and is then carried, as a thin layer having a predetermined thickness, on the developing roller 64.

The toner carried on the developing roller 64 is supplied from the developing roller 64 to the electrostatic latent image formed on the photosensitive drum 61. Thereby, the electrostatic latent image becomes a visible image, so that a toner image is formed on the photosensitive drum 61. Then, the sheet S is conveyed between the photosensitive drum 61 and the transfer roller 63, so that the toner image on the photosensitive drum 61 is transferred on the sheet S.

The fixing unit 7 is arranged at the rear of the developing unit 6 and includes a heating roller 71 and a pressing roller 72 that is opposed to the heating roller 71 and presses the heating roller 71. In the fixing unit 7, the toner image transferred on the sheet S is heat-fixed while the sheet S passes through between the heating roller 71 and the pressing roller 72. The sheet S on which the toner image is heat-fixed is conveyed through a conveyance path 23 by conveyance rollers 73 and is then discharged on a sheet discharge tray 22 from the conveyance path 23 by discharge rollers 24.

<Detailed Configuration of Light Scanning Device>

Next, the detailed configuration of the light scanning device 100 will be described. In the below descriptions, a downstream side of an advancing direction of the laser light emitted from a light source device 120 will be simply referred to as "downstream."

Figure 2:
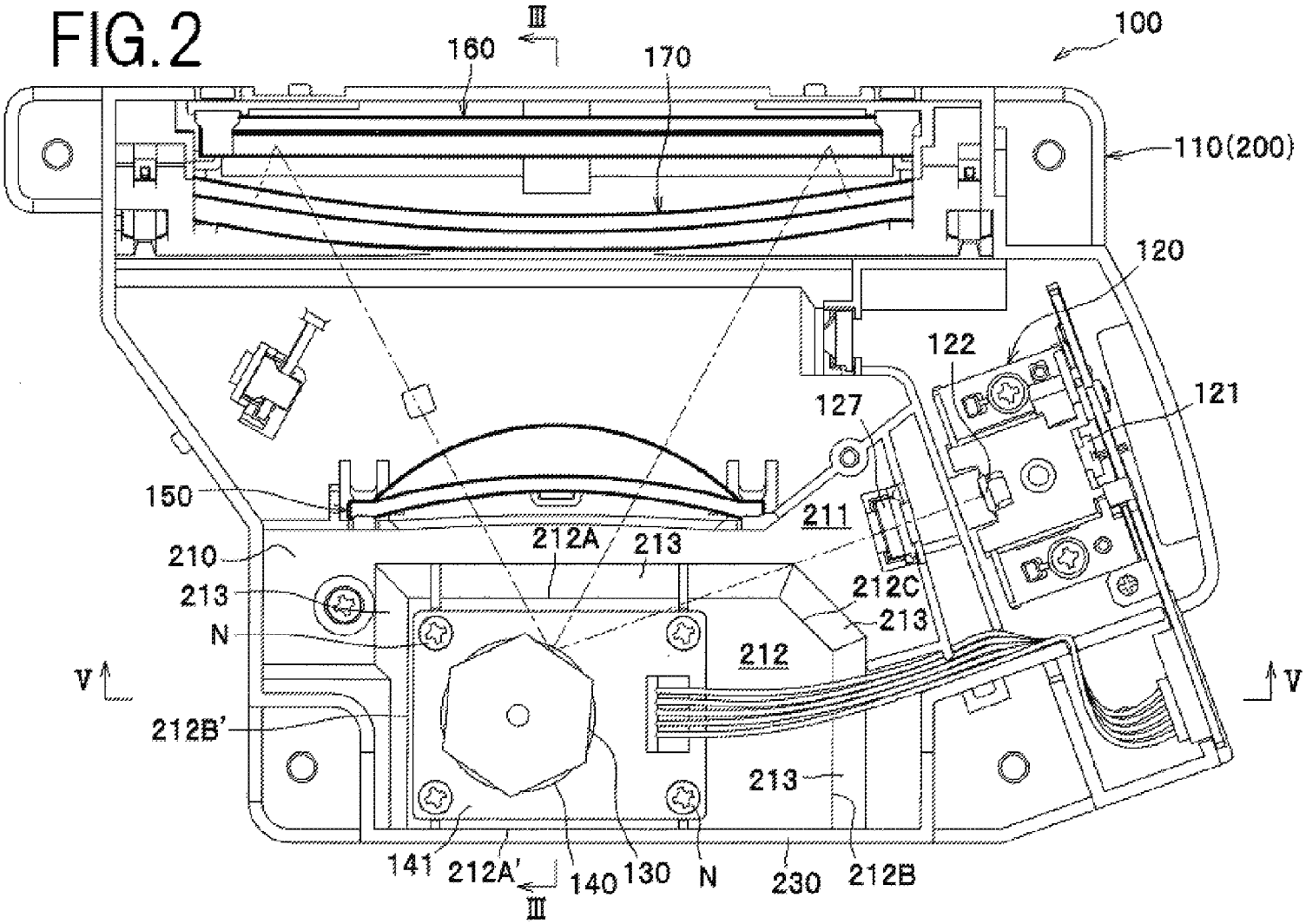
FIG. 2 is a plan view showing a configuration of the light scanning device.
Figure 3:
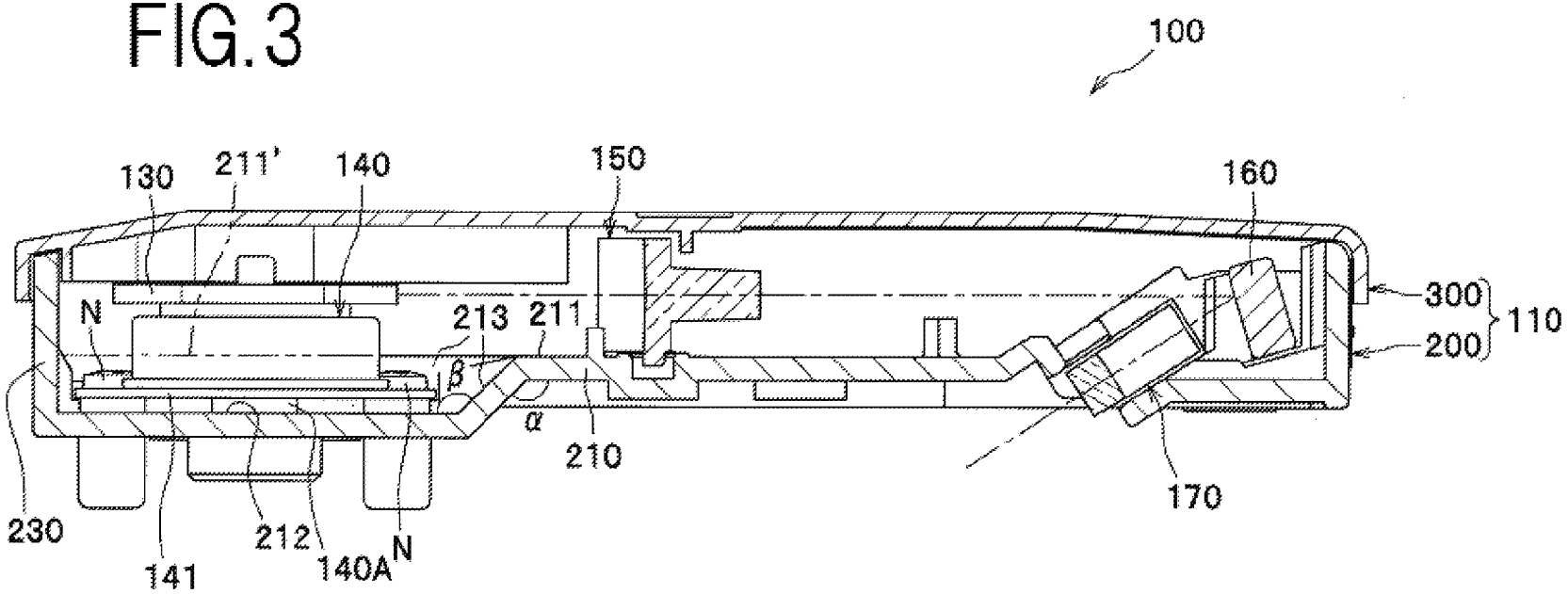
FIG. 3 is a sectional view taken along a line III-III of FIG. 2.

As shown in FIGS. 2 and 3, the light scanning device 100 includes, in a housing 110, a light source device 120, a cylindrical lens 127, a polygon mirror 130 that is an example of a deflector, a polygon motor 140 (motor) that is an example of a driving source, an fθ lens 150, a reflector 160 and a cylindrical lens 170.

The light source device 120 is a well-known device that has a semiconductor laser light source 121, which is an example of a light source emitting laser light (light beam), and a coupling lens 122, which concentrates the laser light emitted from the semiconductor laser light source 121 and converts it into parallel luminous flux.

The cylindrical lens 127 is a scanning lens that is arranged downstream from the light source device 120 and through which the laser light emitted from the light source device 120 passes. The cylindrical lens 127 has a function of converting the laser light emitted from the light source device 120 so that the light forms an image on the polygon mirror 130 (reflective surface) only in a sub-scanning direction (direction perpendicular to a main scanning direction).

The polygon mirror 130 is arranged downstream from the cylindrical lens 127 and has six surfaces of a hexagon, which are reflective surfaces. The polygon mirror 130 reflects the laser light (the laser light having passed through the cylindrical lens 127) from the light source device 120 while rotating at high speed and thus deflects and scans the laser light at a constant angular velocity in the main scanning direction (left-right direction in FIG. 2).

The polygon motor 140 is a motor for rotating the polygon mirror 130 and is supported to the housing 110 by fixing an attaching plate 141 to the housing 110 (support wall 210 of a base frame 200) by screws N. The attaching plate 141 is made of a metal plate and supports a shaft 140A of the polygon motor 140.

The fθ lens 150 is a scanning lens that is arranged downstream from the polygon mirror 130 and through which the laser light deflected and scanned by the polygon mirror 130 passes. The fθ lens 150 has functions of concentrating the laser light, which is scanned at the constant angular velocity by the polygon mirror 130, on the surface of the photosensitive drum 61 and converting the laser light so that it is scanned at a constant velocity.

The reflector 160 is arranged downstream from the fθ lens 150 and reflects the laser light, which has been deflected and scanned by the polygon mirror 130 and then has passed through the fθ lens 150, to thus return its light path, thereby directing the laser light toward the cylindrical lens 170.

The cylindrical lens 170 is a scanning lens that is arranged downstream from the reflector 160 and through which the laser light, which has been deflected and scanned by the polygon mirror 160, has passed through the fθ lens 150 and has been reflected by the reflector 160, passes. The cylindrical lens 170 has a function of refracting and thus converging the laser light in a sub-scanning direction, thereby correcting a face angle of the polygon mirror 130. In addition, the cylindrical lens 170 pairs with the cylindrical lens 127 and has a function of correcting the face angle of the laser light, which has been converted into the luminous flux.

In the light scanning device 100, the laser light (refer to the dashed line), which is emitted from the light source device 120 based on the image data, is reflected or passes through in order of the cylindrical lens 127, the polygon mirror 130, the fθ lens 150, the reflector 160 and the cylindrical lens 170 and then is scanned on the surface (surface to be scanned) of photosensitive drum 61 (refer to FIG. 1) at high speed. Thereby, the surface of the photosensitive drum 61 is exposed, so that an electrostatic latent image based on the image data is formed on the photosensitive drum 61.

The housing 110 is a box-shaped member that supports the light source device 120, the polygon motor 140, the fθ lens 150 and the like. More specifically, the housing 110 has a box-shaped (bowl-shaped) base frame 200 having an opened upper part (upper part in FIG. 3) and a cover frame 300 that is mounted to cover the opened part of the base frame 200, as shown in FIG. 3.

The base frame 200 is formed by injecting resin into a mold, such as injection molding and has at a bottom part of the box a support wall 210 to which the light source device 120, the polygon motor 140, the fθ lens 150 and the like are fixed. As shown in FIGS. 2 to 5, the support wall 210 has a first fixing surface 211, which is an example of a first surface, a second fixing surface 212, which is an example of a second surface, and a plurality of connection surfaces (four connection surfaces) 213, which is an example of a third surface connecting the first fixing surface 211 and the second fixing surface 212.

The first fixing surface 211 is a surface to which the light source device 120, the fθ lens 150 and the like are fixed.

Figure 4:
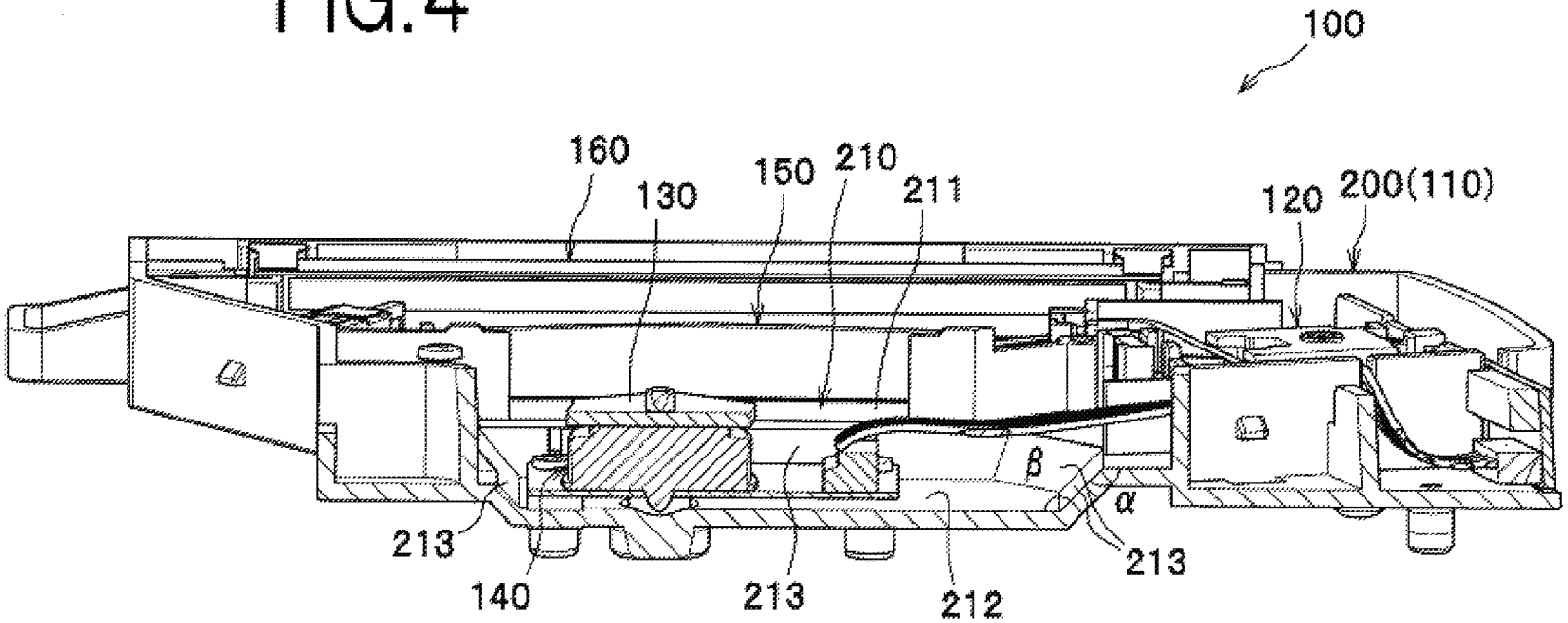
FIG. 4 is a sectional perspective view of the light scanning device.
Figure 5:
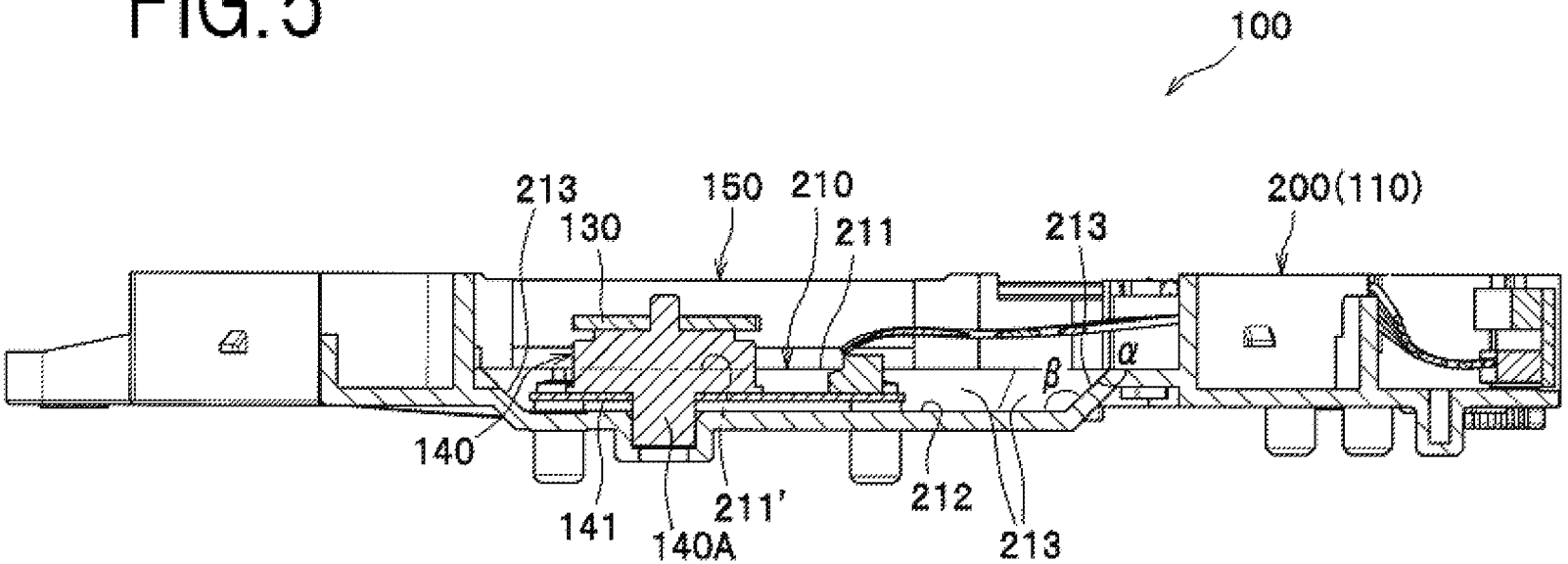
FIG. 5 is a sectional view taken along a line V-V of FIG. 2.

The second fixing surface 212 is a surface to which the polygon motor 140 is fixed, and, as shown in FIGS. 3 to 5, is mounted at a position that is perpendicular to the first fixing surface 211, specifically, deviated downwardly in FIGS. 3 to 5 with respect to the first fixing surface 211. In addition, as shown in FIG. 2, the second fixing surface 212 is mounted so that one side thereof abuts a sidewall 230 of the base frame 200.

The second fixing surface 212 has a pentagonal shape, when seen from a direction perpendicular to the second fixing surface 212. More specifically, the second fixing surface 212 has a pentagonal shape having a first set of sides 212A, 212A' facing each other, a second set of sides 212B, 212B' facing each other and a side 212C.

The sides 212A, 212A' are opposed to each other in the upper-lower direction of FIG. 2, the sides 212B, 212B' are perpendicular to the sides 212A, 212A' and extend to connect end portions of the sides 212A, 212A'. The side 212C extends to obliquely connect an end portion of the side 212A and an end portion of the side 212B.

Thus, the second fixing surface 212 has the pentagonal shape, more specifically, the side 212C extending obliquely, so that it is possible to relieve shaking of the second fixing surface 212 in the direction perpendicular to the sides 212A, 212A' or shaking of the second fixing surface 212 in the direction perpendicular to the sides 212B, 212B', which shaking may be caused by rotation of the polygon motor 140. Thereby, it is possible to make the housing 110 robust to vibration caused due to the rotation of the polygon motor 140.

As shown in FIGS. 3 and 5, the polygon motor 140 fixed to the second fixing surface 212 is arranged on the plane 211' extended from the first fixing surface 211. In other words, the polygon motor 140 is arranged so as to intersect with the plane 211'. According to this configuration, it is possible to easily match optical axes of the polygon mirror 130 and the fθ lens 150.

In this exemplary embodiment, the first fixing surface 211 and the second fixing surface 212 are substantially parallel with each other and are arranged so that they are not overlapped with each other when seen from a direction perpendicular to the first fixing surface 211 and the second fixing surface 212 (refer to FIG. 2). The second fixing surface 212 is positioned inside the first fixing surface 211 so that the four continuing sides (212B', 212A, 212C, 212B) are surrounded by the first fixing surface 211.

The connection surface 213 is inclined to form obtuse angles relative to the first fixing surface 211 and the second fixing surface 212. Specifically, as shown in FIGS. 3 to 5, when seen from a sectional face, an angle $\alpha$ between the first fixing surface 211 and the connection surface 213 and an angle $\beta$ between the second fixing surface 212 and the connection surface 213 are obtuse angles ($\pi/2<\alpha<\pi$ and $\pi/2<\beta<\pi$). Preferably, both the angle $\alpha$ and the angle $\beta$ are set to more than 105 degrees and less than 165 degrees. More preferably, both the angle $\alpha$ and the angle $\beta$ are set to more than 120 degrees and less than 150 degrees.

According to the exemplary embodiment, following effects can be realized.

The support wall 210 to which the polygon motor 140 of the housing 110 is fixed has the first fixing surface 211, the second fixing surface 212 that is deviated with respect to the first fixing surface 211 in the direction perpendicular to the first fixing surface 211 and the connection surface 213*s* that connect the first fixing surface 211 and the second fixing surface 212 and are inclined to form obtuse angles relative to the first fixing surface 211 and the second fixing surface 212, so that it approximates to a shell structure. By this configuration, it is possible to improve the strength of the housing 110.

Furthermore, the connection surfaces 213 are inclined to form obtuse angles relative to the first fixing surface 211 and the second fixing surface 212, so that the support wall 210 has a section shape in which the first fixing surface 211, the connection surfaces 213 and the second fixing surface 212 continue gently. Thereby, when molding the housing 110 (base frame 200) with a mold, it is possible to improve the fluidity of the resin.

According to the light scanning device 100 of this exemplary embodiment, it is possible to improve the strength of the housing 110 and the fluidity of the resin during the molding.

Although the exemplary embodiment has been described, the invention is not limited thereto. The specific configurations may be appropriately changed without departing from the scope of the invention.

Figure 6A:
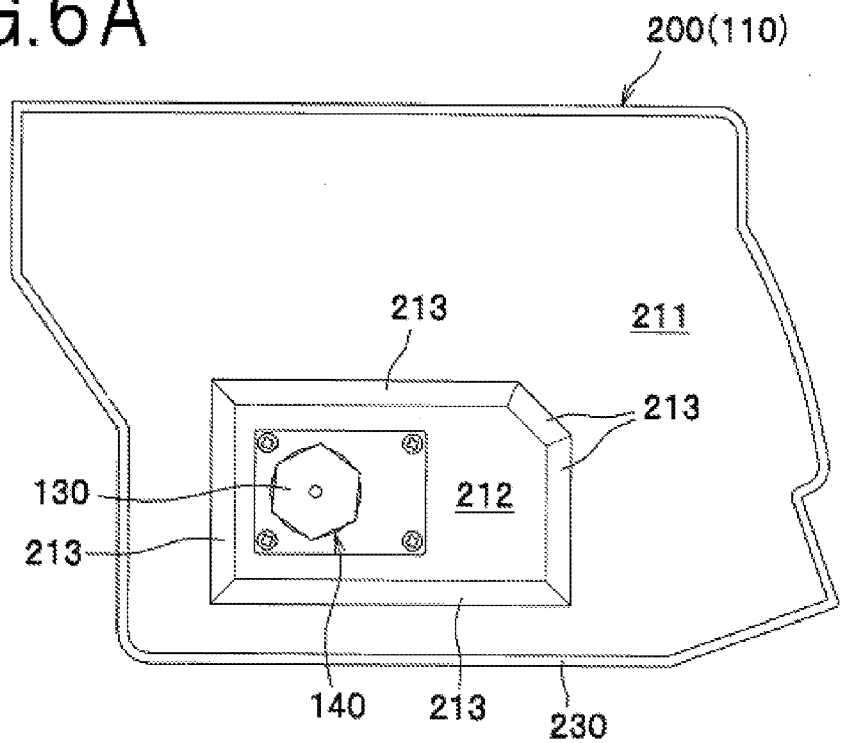
FIGS. 6A and 6B are plan views of a light scanning device according to a modified embodiment.
Figure 6B:
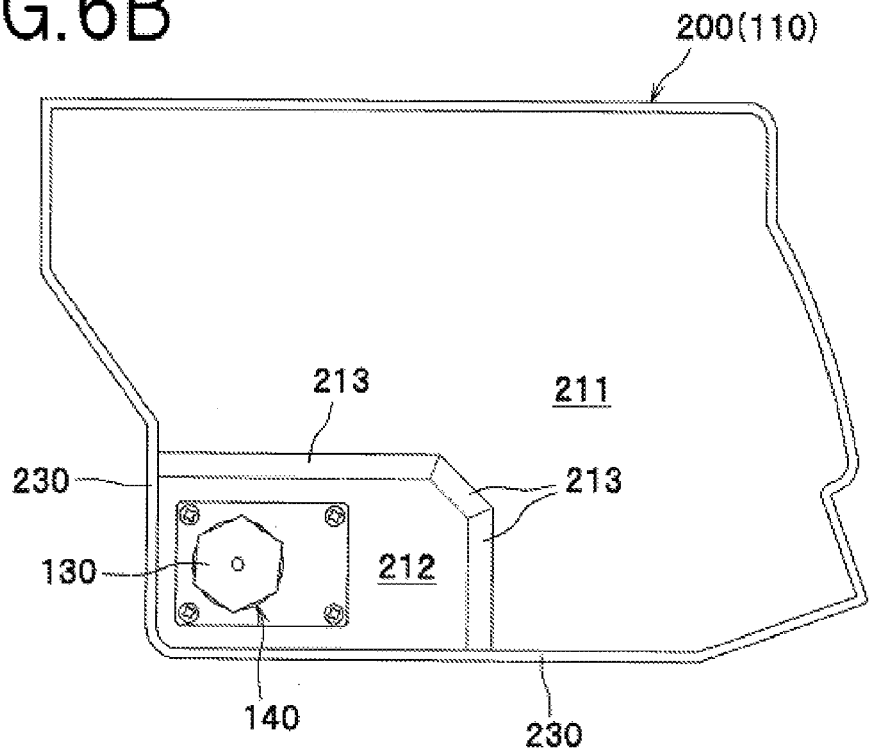

In the above exemplary embodiment, the second fixing surface 212 has one side that abuts the sidewall 230 of the base frame 200. However, the invention is not limited thereto. For example, as shown in FIG. 6A, the second fixing surface 212 may be positioned inside the first fixing surface 211 so that the entire periphery thereof is surrounded by the first fixing surface 211. In addition, as shown in FIG. 6B, the second fixing surface 212 may be positioned so that two sides thereof abut the sidewall 230 of the base frame 200.

Figure 7A:
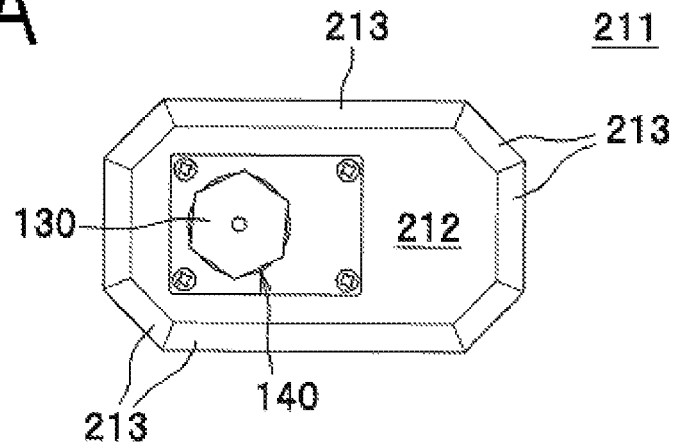
FIGS. 7A to 7C are plan views showing a configuration of a support wall according to a modified embodiment.

In the above exemplary embodiment, the second fixing surface 212 has the pentagonal shape, when seen from a direction perpendicular to the second fixing surface 212. However, the invention is not limited thereto. In other words, the second fixing surface 212 may have a polygonal shape of pentagon or more, for instance, a hexagonal shape, or an octagonal shape as shown in FIG. 7A.

Meanwhile, in the above exemplary embodiment, the shape (pentagonal shape) having one side 212C obliquely connecting one end portion of the side 212A of the first set of sides 212A, 212A' and one end portion of the side 212B of the second set of sides 212B, 212B' has been exemplified. However, the invention is not limited thereto. For example, two or more obliquely connecting sides 212C may be provided. For instance, a shape (octagonal shape; refer to FIG. 7A) having four obliquely connecting sides may be provided.

Figure 7B:
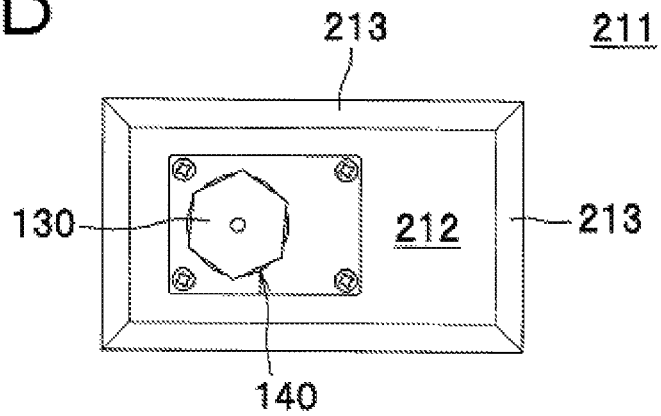
Figure 7C:
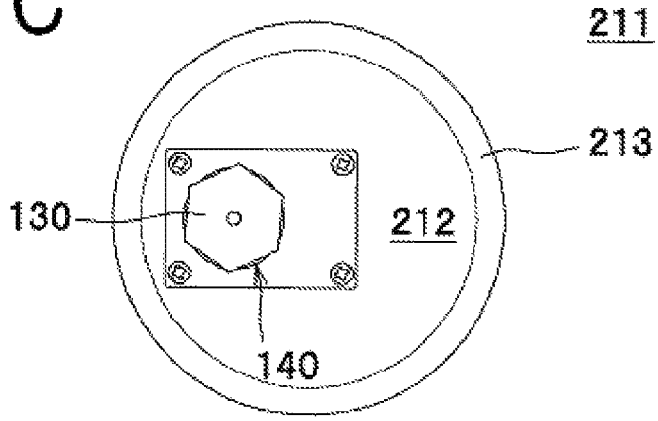

In addition, the second fixing surface 212 may have a quadrangular shape such as rectangular, rhombic and square shapes (for example, refer to FIG. 7B). Furthermore, the second fixing surface may have a circular or elliptical shape (for example, refer to FIG. 7C).

Figure 8:
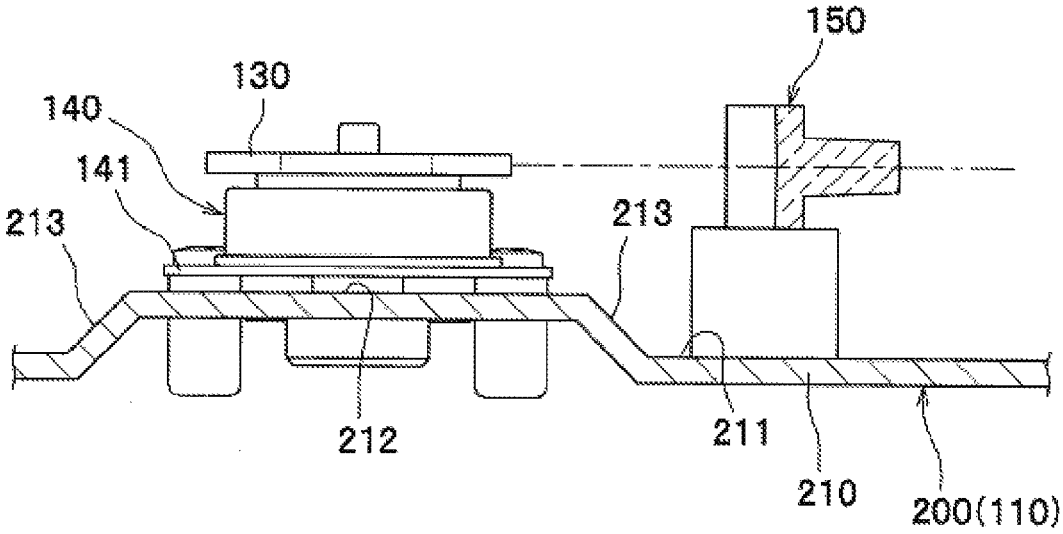
FIG. 8 is a partial sectional view of a light scanning device according to another modified embodiment.

In the above exemplary embodiment, the polygon motor 140 (driving source) is arranged on the extension surface 211' of the first fixing surface 211. However, the invention is not limited thereto. In other words, although the second fixing surface 212 is downwardly deviated with respect to the first fixing surface 211 (refer to FIGS. 3 to 5) in the above exemplary embodiment, the invention is not limited thereto. For example, as shown in FIG. 8, the second fixing surface 212 may be deviated upwardly in FIG. 8, with regard to the first fixing surface 211.

In the above exemplary embodiment, the first fixing surface 211 (first surface) and the second fixing surface 212 (second surface) are substantially parallel with each other. However, the invention is not limited thereto. For example, one of the first and second surfaces may be inclined relatively to the other.

In the above exemplary embodiment, the semiconductor laser light source 121 has been exemplified as the light source. However, the invention is not limited thereto. For example, a solid laser light source such as YAG laser may be adopted.

In the above exemplary embodiment, the laser light, which has been converted into the parallel luminous flux, is emitted from the light source device 120. However, the invention is not limited thereto. For example, convergence light or divergence luminous flux may be emitted.

In the above exemplary embodiment, the polygon mirror 130, which deflects and scans the laser light (light beam) by rotation of the reflective surface, has been exemplified as the deflector. However, the invention is not limited thereto. For example, a vibration mirror that deflects and scans light beam by oscillation of the reflective surface may be adopted.

In the above exemplary embodiment, the laser printer 1 has been exemplified as the image forming apparatus. However, the invention is not limited thereto. For example, a copier or complex machine may be also possible. Further, in the above exemplary embodiment, the embodiment in which the light scanning device of the invention is applied to the image forming apparatus (laser printer 1) has been described. However, the invention is not limited thereto. For example, the light scanning device may be applied to a measurement apparatus or inspection apparatus.

What is claimed is:

1. A light scanning device comprising:

a light source configured to emit a light beam;

a deflector configured to deflect and scan the light beam from the light source in a main scanning direction;

a driving source that drives the deflector; and a housing including a support wall to which the driving source is fixed, wherein the support wall has a first surface to which the light source is fixed, a second surface to which the driving source is fixed and that is recessed with respect to the first surface in a direction perpendicular to the first surface, and a third surface that connects the first surface and the second surface and is inclined to form obtuse angles relative to the first surface and the second surface, wherein the light beam emitted from the light source travels across the first surface and the third surface to the deflector, and wherein the light beam is deflected by the deflector across the third surface and the first surface in the main scanning direction.

2. The light scanning device according to claim 1, wherein the deflector is a polygon mirror, and the driving source includes a motor that rotates the polygon minor.

3. The light scanning device according to claim 1, wherein the second surface has a polygonal shape comprising at least five sides, when seen from a direction perpendicular to the second surface.

4. The light scanning device according to claim 1, wherein the second surface has a first set of sides facing each other, a second set of sides that extends in a direction perpendicular to the first set of sides, and at least one side that obliquely connects an end portion of one of the first set of sides and an end portion of one of the second set of sides, when seen from a direction perpendicular to the second surface.

5. The light scanning device according to claim 1, wherein the second surface has a first side and a second side obliquely connected to the first side.

6. The light scanning device according to claim 1, wherein the driving source intersects with a plane extended from the first surface.

7. The light scanning device according to claim 1, wherein the first surface is parallel to the second surface.

8. The light scanning device according to claim 1, wherein a first angle between the first surface and the third surface and a second angle between the second surface and the third surface are both more than 105 degrees and less than 165 degrees.

9. The light scanning device according to claim 8, wherein the first angle and the second angle are both more than 120 degrees and less than 150 degrees.

* * * * *